US008270892B2

(12) United States Patent
Kawai

(10) Patent No.: US 8,270,892 B2
(45) Date of Patent: Sep. 18, 2012

(54) UNIT FOR CLEANING END PORTION OF RECORDING MATERIAL AND IMAGE FORMING APPARATUS INCLUDING THE UNIT

(75) Inventor: Toshiharu Kawai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 958 days.

(21) Appl. No.: 12/188,518

(22) Filed: Aug. 8, 2008

(65) Prior Publication Data

US 2009/0052963 A1 Feb. 26, 2009

(30) Foreign Application Priority Data

Aug. 22, 2007 (JP) ..... 2007-216114

(51) Int. Cl.
*G03G 15/00* (2006.01)

(52) U.S. Cl. ..... 399/395; 399/98; 399/99; 399/401

(58) Field of Classification Search ..... 399/98, 399/99, 395, 401
See application file for complete search history.

(56) References Cited

U.S. PATENT DOCUMENTS

2007/0280723 A1* 12/2007 Kurosu ..... 399/99

FOREIGN PATENT DOCUMENTS

| | | | |
|---|---|---|---|
| JP | 9-295721 | A | 11/1997 |
| JP | 11-338306 | A | 12/1999 |
| JP | 2000-6385 | A | 1/2000 |
| JP | 2006-171554 | A | 6/2006 |
| JP | 2007-316466 | A | 12/2007 |
| JP | 2007-320667 | A | 12/2007 |

* cited by examiner

*Primary Examiner* — Judy Nguyen
*Assistant Examiner* — Andy Pham
(74) *Attorney, Agent, or Firm* — Fitzpatrick, Cella, Harper & Scinto

(57) ABSTRACT

When a toner image larger than a recording material is formed on an image bearing member, and the toner image is transferred onto the recording material as widely as possible to form an image without margins, a toner in a vicinity of an end portion of the recording material adheres to the recording material while remaining unfixed. In order to suppress the adhesion of the toner to the end portion of the recording material, the recording material is passed through a cleaning unit for the end portion of the recording material after fixation. In the cleaning unit, the recording material is sent askew. By being conveyed while an edge of the end portion of the recording material is rubbed against a cleaning member, the recording material becomes less subject to the adhesion of the toner at the end portion thereof.

8 Claims, 6 Drawing Sheets

UNIT FOR CLEANING END PORTION OF RECORDING MATERIAL AND IMAGE FORMING APPARATUS INCLUDING THE UNIT

BACKGROUND OF THE INVENTION

1. Field of the Invention

The present invention relates to a unit for cleaning an end portion of a recording material and to an image forming apparatus including the unit.

2. Description of the Related Art

In a conventional image forming apparatus of an electrophotographic type, regions as margins where image formation is not performed are provided to the left, right, top and bottom of a recording material. In this manner, image deficits and toner contamination in the apparatus caused by a toner for an unprinted part out of an image forming region due to deviation of accuracy in positioning of the recording material with respect to the image forming regions are prevented.

Meanwhile, Japanese Patent Application Laid-Open No. 2006-171554 suggests an image forming apparatus in which an image without margins is formed which is obtained by a toner image formed up to the end portions of a recording material without providing margins. In the case of printing the image without margins, a toner image relatively larger than the recording material is formed onto an image bearing member such as an intermediate transfer member, and the toner image formed on the image bearing member is transferred the recording material. In this manner, even when the positions of the toner image formed on the image bearing member and the recording material are deviated from each other to some extent, margins are not allowed to be present on the recording material.

However, in this case, the toner for the unprinted part out of an image forming region on the recording material may adhere the edges (end portions) of the recording material.

Normally, in a conventional image forming apparatus of an electrophotographic type, a toner is fixed onto the recording material by heating and pressurizing a transferred recording material in a fixing device. However, heat and pressure are not efficiently transmitted to the edges of the recording material, and hence the toner is not fixed in some cases even after passing through the fixing device. Further, there is a problem in that a stain of toner left at the end portions of the recording material having passed through the fixing device taints the circumference thereof when being peeled off afterward.

SUMMARY OF THE INVENTION

An object of the present invention is to suppress a stain of toner at end portions of a recording material onto which a toner image without margins is formed.

Another object of the present invention is to provide An image forming apparatus, including an image bearing member that bears a toner image larger than a size of a recording material; a transfer member that attracts the toner image being larger than a size of a recording material from said image bearing member and reaching an end portion of the recording material and transfers the toner image larger than the size of the recording material to the recording material; a fixing device that fixes the toner image transferred onto the recording material to be fixed to the recording material; a cleaning member that cleans the end portion of the recording material by being brought into contact, during movement of the recording material, with the end portion of the recording material from a side perpendicular to a conveyance direction of the recording material; and a skew-conveyance member that sends the recording material toward the cleaning member by sending askew the recording material with respect to a line of the end portion of the recording material, wherein, on a conveyance path of the recording material, the cleaning member is provided at a downstream of the fixing device.

A further object of the present invention is to provide a unit for receiving a recording material discharged from an image forming apparatus in which the recording material including thereon a toner image formed up to an end portion thereof is passed through a fixing device and is discharged, including a cleaning member that cleans the end portion of the recording material by being brought into contact, during movement of the recording material, with the end portion of the recording material from a side perpendicular to a conveyance direction of the recording material; and a skew-conveyance member that sends the recording material toward the cleaning member by sending askew the recording material with respect to a line of the end portion of the recording material.

A still further object of the present invention is to be apparent with reference to the following description of exemplary embodiments and the attached drawings.

DESCRIPTION OF THE EMBODIMENTS

In the following, with reference to the drawings, an exemplary embodiment of the present invention is exemplarily described in detail. Note that, dimensions, materials, and configurations of components described in the following embodiment and relative disposition thereof should be appropriately modified according to the structure of an apparatus to which the present invention is applied and various conditions. Thus, the following embodiment is not construed to limit the scope of the present invention unless specific descriptions thereof are made.

Figure 1:
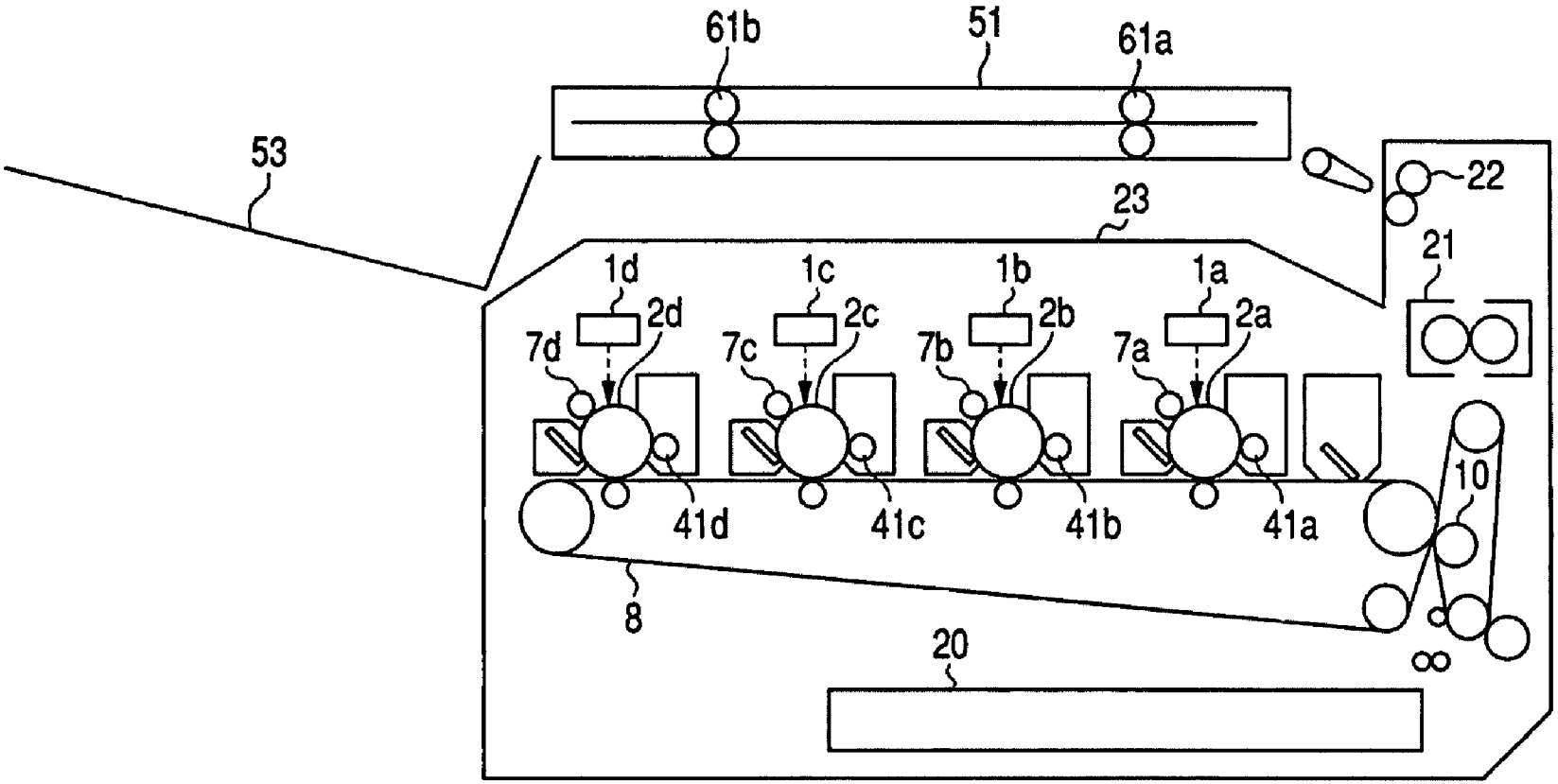
FIG. 1 is a vertical sectional view schematically illustrating a structure of an image forming apparatus according to an embodiment of the present invention.

FIG. 1 is a vertical sectional view schematically illustrating a structure of an electrophotographic image forming apparatus (full 4 color printer) according to an embodiment of the present invention.

(Overview of Image Forming Operation of Color Image Forming Apparatus)

As illustrated in FIG. 1, the image forming apparatus is equipped with four cartridges which respectively include photosensitive member drums 2*a* to 2*d*, charge rollers 7*a* to 7*d*, and toner supplying rollers 41*a* to 41*d*, and has toners of different colors built-in, respectively.

At the start of the image forming operation, the charge roller 7 uniformly charges the surface of the photosensitive member drum 2, and exposure devices 1*a* to 1*d* each emit a laser beam to expose a portion onto which an image is to be formed. In this manner, an electrostatic latent image is formed.

Then, a portion of the electrostatic latent image is applied with a toner by each of the toner supplying rollers 41*a* to 41*d* so as to be developed, and toner images thus obtained are sequentially transferred onto an intermediate transfer belt 8 serving as an image bearing member so as to be superimposed on each other. In this manner, a full color image is formed. In conformity with a timing of the image formation, recording materials S such as sheets are sent out which are loaded in a recording material cassette 20. The image is transferred to the recording material conveyed to the intermediate transfer belt 8 by biasing a secondary transfer roller 10, and is fixed onto the recording material by being heated and pressurized by a fixing device 21. Then, the recording material is loaded onto a discharge tray 23.

Above the discharge tray 23, an intermediate conveyance path unit 51 is disposed. The recording materials discharged from discharge rollers 22 are conveyed by pairs of receive and conveyance rollers 61*a* and 62*b*, and are loaded onto a second discharge tray 53. Note that, the second discharge tray 53 may be appropriately replaced with an option such as a multistage discharge tray or a stapling mechanism.

(Recording With Margins)

Figure 2:
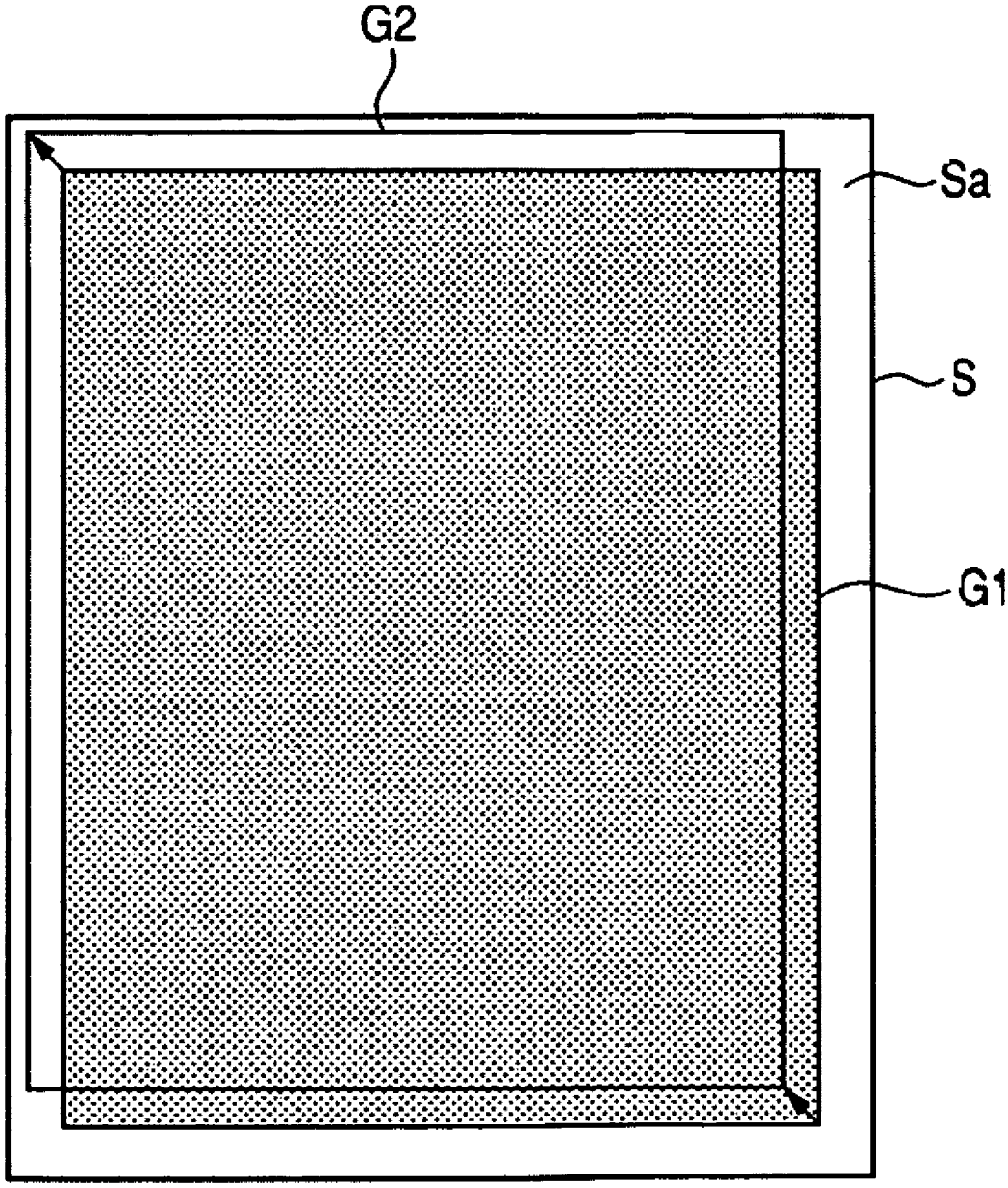
FIG. 2 illustrates a state where a marginal region in which an image is not formed is provided on a recording material of a conventional art.

FIG. 2 illustrates a state where a marginal region in which an image G1 is not formed is provided on a recording material S of a conventional art. As illustrated in FIG. 2, even when the positions of the image and the recording material are deviated from each other as in the case of an image G2, errors can be absorbed owing to a marginal region Sa. This configuration prevents image deficits on the recording material S caused by a toner for an unprinted part of the image G1 out of an image forming region and prevents the secondary transfer roller 10, the intermediate transfer belt 8, and the like from being stained by the toner for the unprinted part out of the image forming region.

In the image forming apparatus of this embodiment as well, image formation is performed while providing margins as described above in the case where an image without margins is not required.

(Recording Without Margins)

Figure 3:
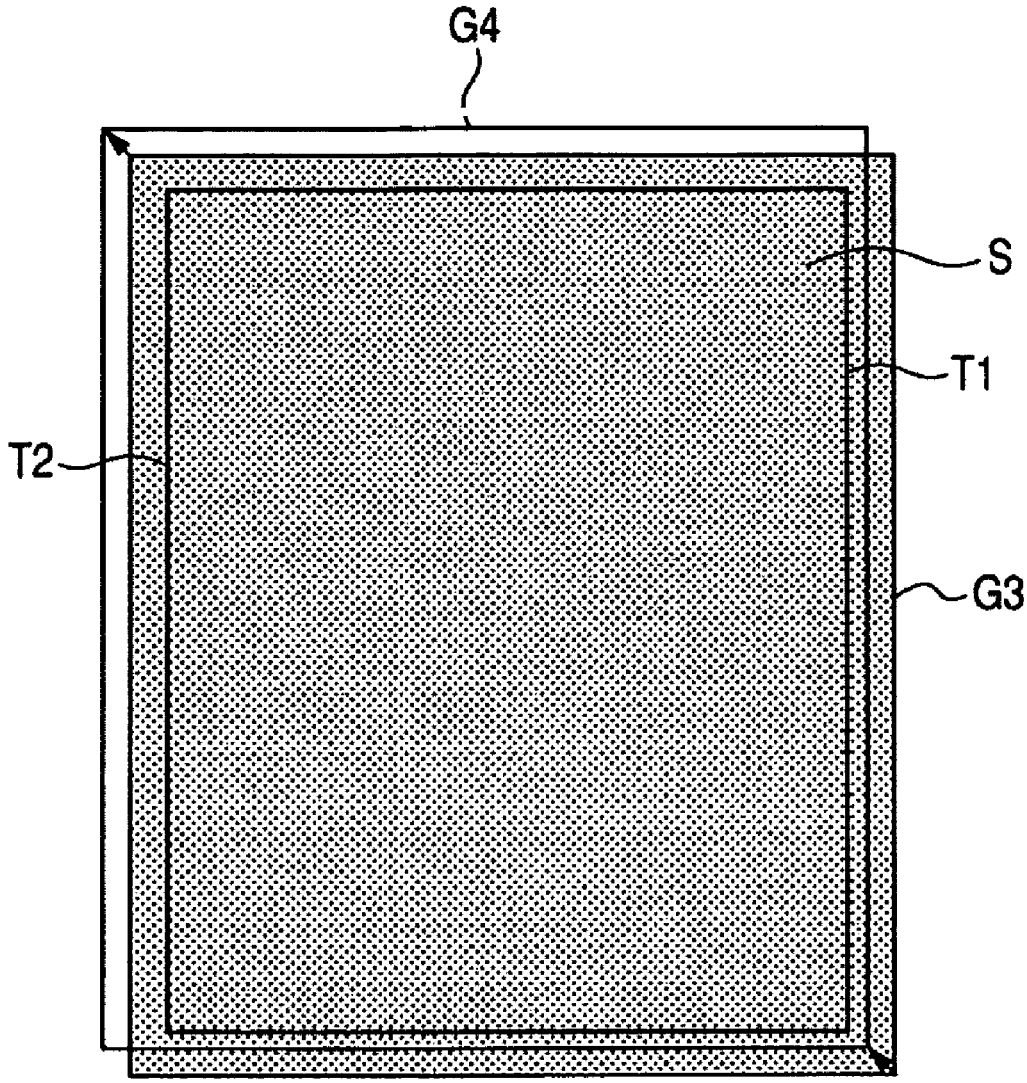
FIG. 3 illustrates a relationship between a recording material and an image at the time of performing recording an image without margins in the image forming apparatus according to the embodiment of the present invention.

FIG. 3 illustrates a relationship between the recording material S and an image G3 at the time of performing recording without margins in the image forming apparatus of this embodiment. As illustrated in FIG. 3, in contrast to the case of providing margins (recording with margins), the image G3 is formed over a range larger than the recording material S so as to prevent the margins from being present owing to errors in positional deviation of the recording material S with respect to the image. That is, even when the position of the image is deviated as in the case of an image G4, the toner image can be formed without margins on the entire surface of the recording material. As a result of forming an image outside the recording material, at a time of recording without margins, a surplus toner may adhere to edges of the recording material S including T1 and T2.

(Cleaning of Edges of Recording Material S)

Figure 4:
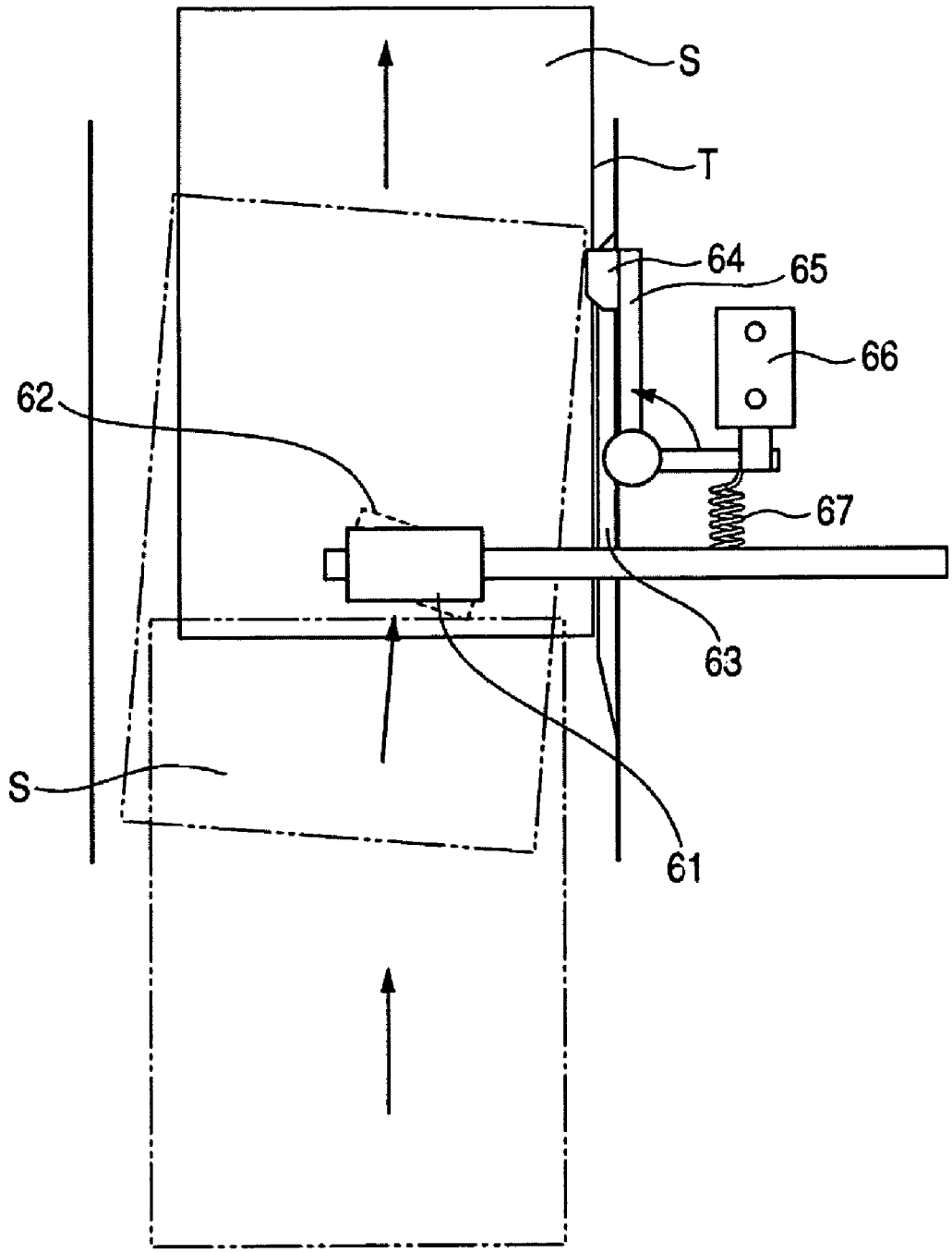
FIG. 4 illustrates a cleaning member and a guide member according to the embodiment of the present invention at a contact position.
Figure 5:
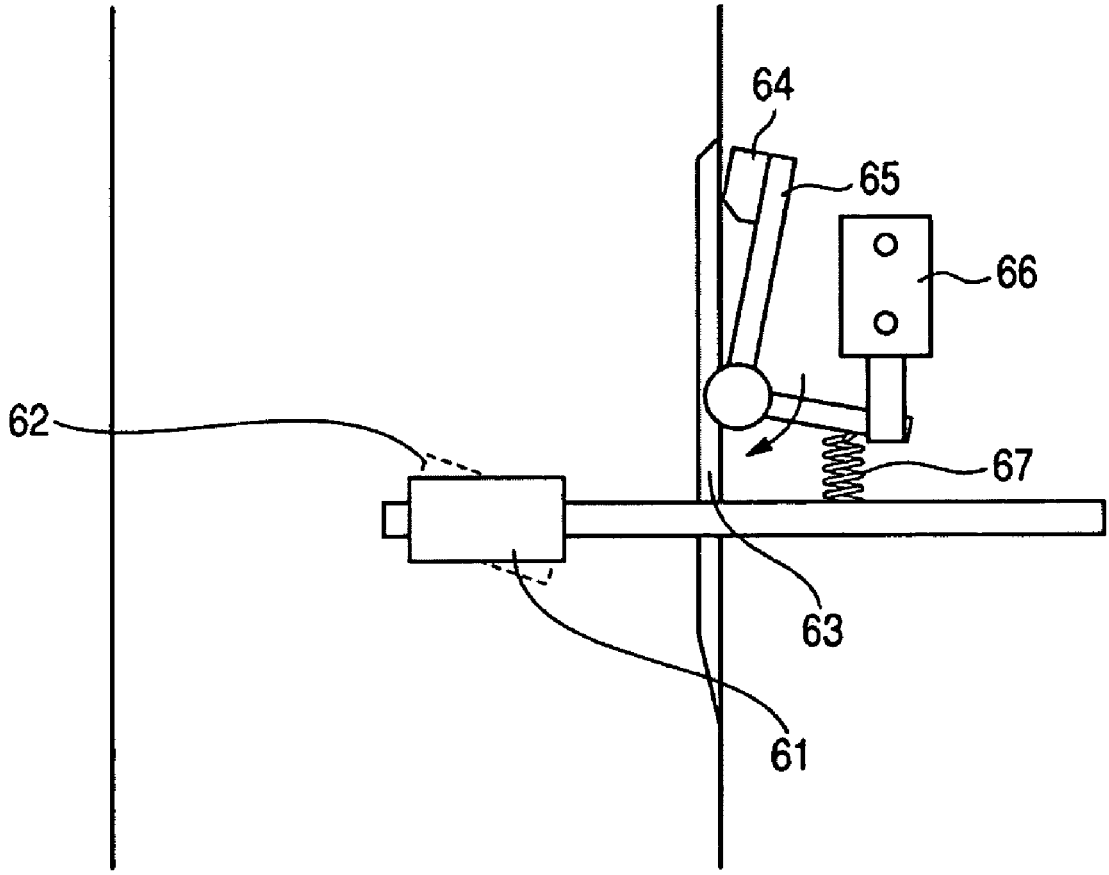
FIG. 5 illustrates the cleaning member and the guide member according to the embodiment of the present invention at a spaced position.

FIG. 4 illustrates a cleaning member and a guide member of this embodiment at a contact position. FIG. 5 illustrates the cleaning member and the guide member of this embodiment at a spaced position.

As illustrated in FIG. 4, the image forming apparatus includes a conveyance roll (skew-conveyance member) 62 opposed to a conveyance roller 61, an abutting guide (guide member) 63, and a cleaning member 64. The conveyance roll 62, the abutting guide 63, and the cleaning member 64 constitute a sheet edge cleaning mechanism.

The conveyance roll 62 is disposed while inclined with respect to the rotational shaft of the conveyance roller 61. The recording material S conveyed from an upstream in a sheet conveyance direction is sent in a diagonal direction after reaching the conveyance roller 61. Until the edge T of the recording material abuts against the abutting guide 63, the recording material is moved in a sheet width direction perpendicular to the sheet conveyance direction.

At a downstream in the sheet conveyance direction of the abutting guide 63, the cleaning member 64 is provided for scraping off the toner adhering to the edge T by being brought into contact with the edge T of the recording material S. The cleaning member 64 is formed of an elastic material such as urethane foam, for example.

The cleaning member 64 is fixed to an arm member 65 so as to be movable, with an aid of a solenoid 66 and a spring 67, between the contact position (position of FIG. 4) at which the cleaning member 64 is contactable with the edge T of the recording material S and the spaced position (position of FIG. 5) at which the cleaning member 64 is spaced apart from the edge T of the recording material S.

At the contact position, the cleaning member 64 protrudes into a sheet conveyance region with respect to the abutting guide 63, and at the spaced portion, the cleaning member 64 is retracted outside the sheet conveyance region. With switching the contact state and the non-contact state with respect to the edge T of the recording material S, when recording without margins is not performed, the conveyance load applied on the recording material S can be reduced while preventing the cleaning member 64 from being brought into contact therewith. As a result, the service life of the cleaning member 64 can be increased.

Note that, owing to a certain ratio of recording without margins and a certain strength of the cleaning member 64, the switching mechanism (arm member 65, solenoid 66, and spring 67) as described above may not be obligatory, and the cleaning member 64 may be fixed.

Figure 6:
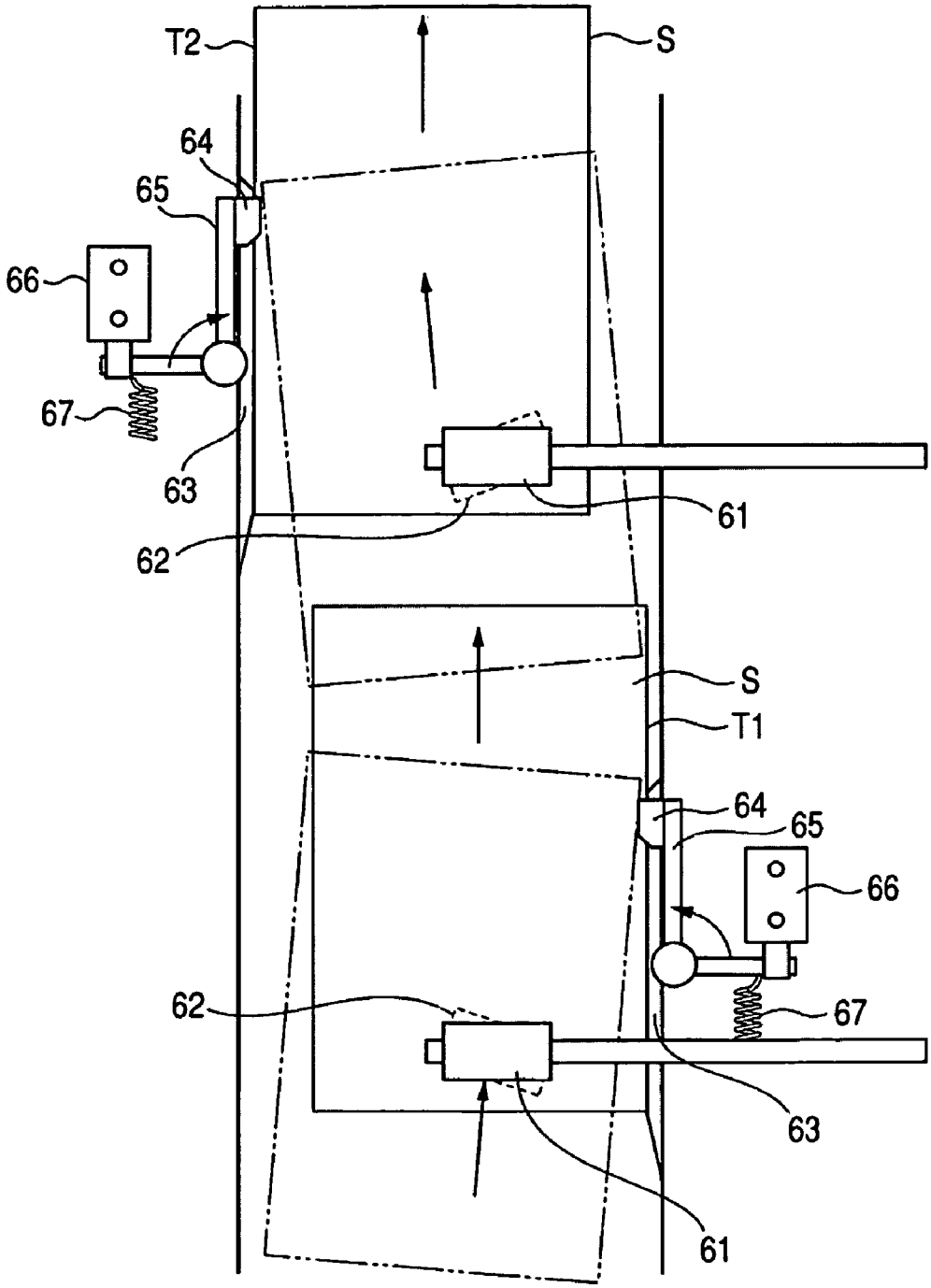
FIG. 6 is a top view illustrating a structure in which both edges of the recording material are cleaned by the combination of the mechanisms illustrated in FIG. 4 for cleaning end portions of the recording material.

Further, as illustrated in FIG. 6, two sets of the conveyance rolls 62, the abutting guides 63, and the cleaning members 64 may be provided on both sides in the sheet width direction (left and right in sheet conveyance direction) in the sheet conveyance region while displaced from each other at an upstream and downstream in the sheet conveyance direction.

With this structure, the recording material S is sent askew and leftward by the conveyance roll 62 in the sheet conveyance direction of FIG. 6, after the edge T1 of the recording material is cleaned as described above by the conveyance roll 62, the abutting guide 63, and the cleaning member 64 provided on the right side in the sheet conveyance direction of FIG. 6. Then, the recording material S is brought into contact with the abutting guide 63 on the left side, and the edge T2 thereof is cleaned by the cleaning member 64 on the left side.

In this manner, the edge T on the opposite side can be cleaned as well, with the result that both the edges T1 and T2 of the recording material S can be cleaned by being passed through the intermediate conveyance path unit.

Further, as described above, since the recording materials S are conveyed while abutting against the abutting guide 63, the lateral positions of the recording materials S are aligned, whereby the sheet bundle is loaded more orderly on the discharge tray 53.

Note that, not only when the recording material is free from blank portions, but also when the toner image is formed on a part of the edges of the recording material, the same effect as described above is attained.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2007-216114, filed Aug. 22, 2007, which is hereby incorporated by reference in its entirety.

What is claimed is:

1. An image forming apparatus, comprising:

an image bearing member that bears a toner image larger than a size of a recording material;

a transfer member that transfers the toner image from the image bearing member to the recording material;

a fixing device that fixes the toner image transferred onto the recording material to be fixed to the recording material;

a cleaning member that cleans an edge of the recording material in a width direction of the recording material, the width direction being perpendicular to a conveyance direction of the recording material;

a skew roller provided at a downstream of the fixing device and an upstream of the cleaning member in the conveyance direction of the recording material; and a guide member that guides an end portion of the recording material, the guide member being provided at least in part on a downstream side of the skew roller in a recording material conveyance direction and provided at least in part on an upstream side of the cleaning member, wherein the recording material that passes through the fixing device is conveyed in a first direction and the skew roller conveys the sheet in a second direction skewed to the first direction, wherein the guide member contacts the recording material conveyed in the second direction and regulates a position of the recording material, and wherein the cleaning member contacts the edge of the recording material whose position is regulated by the guide member and cleans the recording material.

2. An image forming apparatus according to claim 1, wherein the conveyance direction of the recording material is changed to the first direction by bringing the recording material in contact with the guide member.

3. An image forming apparatus according to claim 1, wherein the guide member regulates a position of the recording material in the width direction of the recording material by contacting the recording material whose conveyance direction is changed to the second direction by the skew roller.

4. An image forming apparatus according to claim 1, wherein the cleaning member is fixed in the width direction of the recording material.

5. An image forming apparatus according to claim 1, wherein the cleaning member is retracted to a position where the cleaning member does not contact with the recording material whose conveyance direction is changed to the second direction by the skew roller.

6. An image forming apparatus according to claim 1, comprising:

an opposite-side-cleaning member provided at a side of the recording material opposite to a side of the recording material proximate to the cleaning member; and another skew roller that conveys a recording material to a third direction that is different from the second direction so as to bring a recording material into contact with the opposite-side-cleaning member.

7. An image forming apparatus according to claim 1, wherein the image bearing member includes an intermediate transfer member onto which a toner image is primarily transferred from photosensitive members.

8. An image forming apparatus according to claim 1, wherein the image forming apparatus is capable of transferring toner to the edge of the recording material.

* * * * *